US011515657B2

(12) United States Patent
Ho

(10) Patent No.: US 11,515,657 B2
(45) Date of Patent: Nov. 29, 2022

(54) ELECTRICAL CONNECTOR AND METHOD FOR MANUFACTURING SAME

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/477,642

(22) Filed: Sep. 17, 2021

(65) Prior Publication Data

US 2022/0006226 A1 Jan. 6, 2022

Related U.S. Application Data

(62) Division of application No. 16/740,823, filed on Jan. 13, 2020, now Pat. No. 11,152,732.

(30) Foreign Application Priority Data

Jan. 15, 2019 (CN) ..... 201910035125.0

(51) Int. Cl.

| | |
|---|---|
| ***H01R 13/40*** | (2006.01) |
| ***H01R 13/41*** | (2006.01) |
| ***H01R 13/24*** | (2006.01) |
| ***H01R 43/20*** | (2006.01) |

(52) U.S. Cl.

CPC ..... *H01R 13/41* (2013.01); *H01R 13/2457* (2013.01); *H01R 13/2464* (2013.01); *H01R 43/20* (2013.01)

(58) Field of Classification Search

CPC .... H01R 13/40; H01R 13/41; H01R 13/2457; H01R 13/2464; H01R 43/20

USPC ..... 439/733.1

See application file for complete search history.

(56) References Cited

U.S. PATENT DOCUMENTS

| | | | | |
|---|---|---|---|---|
| 10,116,079 | B1 * | 10/2018 | Ju | H01R 13/2442 |
| 10,547,136 | B2 * | 1/2020 | Ho | H01R 13/2464 |
| 10,777,929 | B2 * | 9/2020 | Hwang | H01R 43/20 |
| 11,152,732 | B2 * | 10/2021 | Ho | H01R 13/2457 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical connector includes at least one conductive terminal mounted to a housing. The conductive terminal has a body, two elastic arms formed by extending upward from the body, a conducting portion connected below the body and having a strip connecting portion to be connected to a first strip, and a connecting portion provided at an upper end of the body to be connected to a second strip to assist mounting and located between the two elastic arms. A method for manufacturing the electrical connector includes: forming at least one conductive terminal and a first strip connected thereto; connecting a second strip to the connecting portion of the conductive terminal; disconnecting the conducting portion of the conductive terminal and the first strip; operating the second strip to control the conductive terminal to be mounted to a housing; and releasing a control force of the second strip onto the conductive terminal.

15 Claims, 13 Drawing Sheets

ELECTRICAL CONNECTOR AND METHOD FOR MANUFACTURING SAME

CROSS-REFERENCE TO RELATED PATENT APPLICATION

This application is a divisional application of U.S. application Ser. No. 16/740,823, filed Jan. 13, 2020, now pending, which itself claims priority to and the benefit of, pursuant to 35 U.S.C. § 119(a), patent application Serial No. CN201910035125.0 filed in China on Jan. 15, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a method for manufacturing the same, and more particularly to an electrical connector for transmitting high frequency signals and a method for manufacturing the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has multiple conductive terminals. Each of the conductive terminals has a base, two elastic arms connected above the base, a soldering portion connected below the base, and a strip connecting portion connected above the base and protruding from one side of the two elastic arms. The strip connecting portion is used for connecting a strip. With the continuous miniaturization of electronic components, on the premise of ensuring performance, the conductive terminals of the electrical connector are often required to be densely arranged. That is, more conductive terminals are placed in a unit area. However, each conductive terminal of the conventional electrical connector has a strip connecting portion protruding from the side edge thereof, which occupies a large space in a horizontal direction, and the requirement of dense arrangement of the conductive terminals cannot be satisfied. In addition, when multiple conductive terminals are arranged densely to transmit high frequency signals, the strip connecting portion protruding from the side edge of each conductive terminal is too close to other conductive terminals, causing crosstalk interference to other conductive terminals, thereby affecting the transmission of the high frequency signals.

Therefore, a heretofore unaddressed need to design an improved electrical connector exists in the art to address the aforementioned deficiencies and inadequacies.

SUMMARY

In view of the deficiency in the background, the present invention is directed to an electrical connector that saves the space occupied by the conductive terminals and reduces crosstalk between the conductive terminals, and a method for manufacturing the same.

To achieve the foregoing objective, the present invention adopts the following technical solutions:

An electrical connector includes: at least one conductive terminal mounted to a housing, wherein the conductive terminal has: a body; two elastic arms formed by extending upward from the body; a conducting portion connected below the body, wherein the conducting portion has a strip connecting portion to be connected to a first strip; and a connecting portion provided at an upper end of the body to be connected to a second strip to assist mounting the whole conductive terminal to the housing, wherein the connecting portion is located between the two elastic arms.

In certain embodiments, the strip connecting portion is provided on a lower end of the conducting portion, and the conducting portion has two retaining arms located at two opposite sides of the strip connecting portion to clamp a solder.

In certain embodiments, each of the elastic arms has a first section connected to the body, a bending section connected to the first section, and a second section connected to the bending section, the two first sections of the two elastic arms are parallel to each other, the two second sections of the two elastic arms are parallel to each other, and a distance between the two first sections of the two elastic arms is greater than a distance between the two second sections of the two elastic arms.

In certain embodiments, the first section and the second section of each of the elastic arms are provided in parallel.

In certain embodiments, a through slot is formed between the two elastic arms, the conductive terminal further has a bridge portion connecting the two elastic arms, and the bridge portion and the body are located at two opposite ends of the through slot.

In certain embodiments, the through slot comprises a first through slot and a second through slot in communication with each other, the first through slot is adjacent to the body, and a width of the connecting portion is greater than a width of the second through slot.

In certain embodiments, the bridge portion is connected to tail ends of the two elastic arms to upward abut a chip module.

An electrical connector includes: at least one conductive terminal mounted to a housing, wherein the conductive terminal has: a body; two elastic arms formed by extending upward from the body; a bridge portion connecting the two elastic arms; a conducting portion connected below the body, wherein the conducting portion has a strip connecting portion to be connected to a first strip; and a connecting portion provided at an upper end of the body to be connected to a second strip at a side surface thereof to assist mounting the whole conductive terminal to the housing, wherein the connecting portion is located between the two elastic arms.

A method for manufacturing an electrical connector includes: step 1: forming at least one conductive terminal and a first strip connected to the at least one conductive terminal, wherein the conductive terminal has a conducting portion provided at a lower end thereof and connected to the first strip, two elastic arms provided at an upper end thereof, and a connecting portion located between the two elastic arms; step 2: connecting a second strip to the connecting portion; step 3: disconnecting the conducting portion and the first strip; step 4: operating the second strip to control the conductive terminal to be mounted to a base; and step 5: releasing a control force of the second strip onto the conductive terminal.

In certain embodiments, prior to the step 2, at least one bonding portion is formed on the second strip; in the step 2, the bonding portion is fixed to the corresponding connecting portion; and in the step 5, the connecting portion is broken below the bonding portion to remove the second strip.

In certain embodiments, in the step 1, a breaking groove is formed on the connecting portion; in the step 2, the bonding portion is connected to the connecting portion above the breaking groove; and in the step 5, the connecting portion is broken by the breaking groove.

In certain embodiments, a base portion and at least one connecting arm are formed on the second strip being provided, the connecting arm connects the base portion and the corresponding bonding portion and extends between the base portion and the corresponding bonding portion, and the base portion is deviated by the connecting arm in the horizontal direction relative to the bonding portion; in the step 2, the connecting arm is provided to be higher than the elastic arms; and in the step 5, the second strip is swung along a direction close to the elastic arms and a direction away from the elastic arms.

In certain embodiments, in the step 1, a through slot is formed on the conductive terminal, and the through slot is located between the two elastic arms; and in the step 5, in a process of swinging the second strip, the connecting arm enters and leaves the through slot.

In certain embodiments, prior to the step 2, at least one bonding portion is formed on the second strip; in the step 2, the bonding portion is fixed to the corresponding connecting portion; and in the step 5, the second strip is broken at a portion other than the bonding portion to remove the second strip other than the bonding portion.

In certain embodiments, prior to the step 2, at least one pre-breaking groove is formed at a portion other than the bonding portion on the second strip; and in the step 5, the second strip is broken by the pre-breaking groove.

In certain embodiments, a base portion and at least one connecting arm are formed on the second strip being provided, the connecting arm connects the base portion and the corresponding bonding portion and extends between the base portion and the corresponding bonding portion, and the base portion is deviated by the connecting arm in the horizontal direction relative to the bonding portion; in the step 2, the connecting arm is provided to be higher than the elastic arms; and in the step 5, the second strip is swung along a direction close to the elastic arms and a direction away from the elastic arms.

In certain embodiments, in the step 1, a through slot is formed on the conductive terminal, and the through slot is located between the two elastic arms; and in the step 5, in a process of swinging the second strip, the connecting arm enters and leaves the through slot.

In certain embodiments, prior to the step 2, at least one bonding portion is formed on the second strip, wherein the bonding portion has a flat plate portion and two retaining portions formed by bending and extending from two sides of the flat plate portion, and the flat plate portion and the two retaining portions defines an accommodating groove; and in the step 2, the connecting portion is sleeved in the accommodating groove.

In certain embodiments, prior to the step 2, at least one rib is formed on an inner side plate surface of each of the retaining portions to protrude into the accommodating groove; and in the step 2, the ribs of the two retaining portions abut the connecting portion.

In certain embodiments, in the step 5, the second strip is completely removed from the connecting portion.

In certain embodiments, in the step 1, a through slot is formed on the conductive terminal, the through slot is located between the two elastic arms, and the conductive terminal has a bridge portion connecting the two elastic arms.

In certain embodiments, in the step 1, a metal plate is provided, and the at least one conductive terminal and the first strip are formed on the metal plate, each of the at least one conductive terminal has a body being flat plate shaped and the two elastic arms formed by extending upward from the body, the connecting portion is flat plate shaped and is connected to an upper end of the body, and the connecting portion and the body are located on a same vertical plane.

In certain embodiments, in the step 1, a through slot is formed on the conductive terminal, the through slot is formed between the two elastic arms, and a top portion of the connecting portion is located outside and above the through slot.

Compared with the related art, the electrical connector and the method for manufacturing the same according to certain embodiments of the present invention has the following beneficial effects. The strip connecting portion to be connected to the first strip is provided on the conducting portion, the conducting portion is located below the body, the connecting portion to be connected to the second strip is located above the body and located between the two elastic arms, and the strip connecting portion and the connecting portion do not laterally protrude from the conductive terminal. Thus, the conductive terminal occupies less space, which facilitates the electrical connector accommodating more conductive terminals per unit area, thereby facilitating miniaturization of the electrical connector. Since the strip connecting portion and the connecting portion do not laterally protrude from the conductive terminal, a certain distance is reserved between the conductive terminal and other surrounding conductive terminals. Thus, it is not easy for the conductive terminal to crosstalk with other surrounding conductive terminals, which is advantageous for transmitting high frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
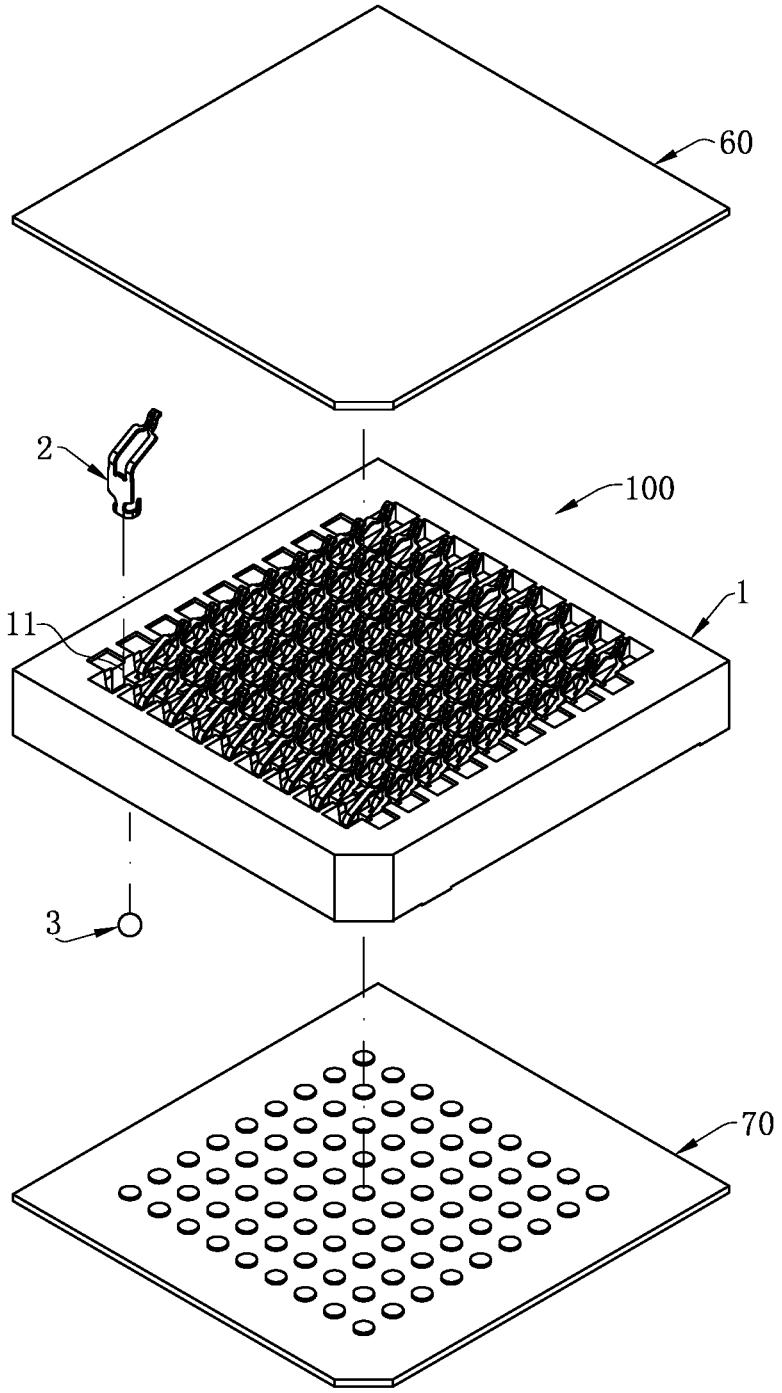
FIG. 1 is a perspective view of an electrical connector, a chip module and a circuit board according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector and a method for manufacturing the same.

FIG. 1 shows an electrical connector 100 according to a first embodiment of the present invention, which is used to electrically connect a chip module 60 to a circuit board 70. The electrical connector 100 includes a housing 1 and multiple conductive terminals 2 mounted to the housing 1. Each of the conductive terminals 2 is fixed to the circuit board 70 through a solder 3.

Figure 5:
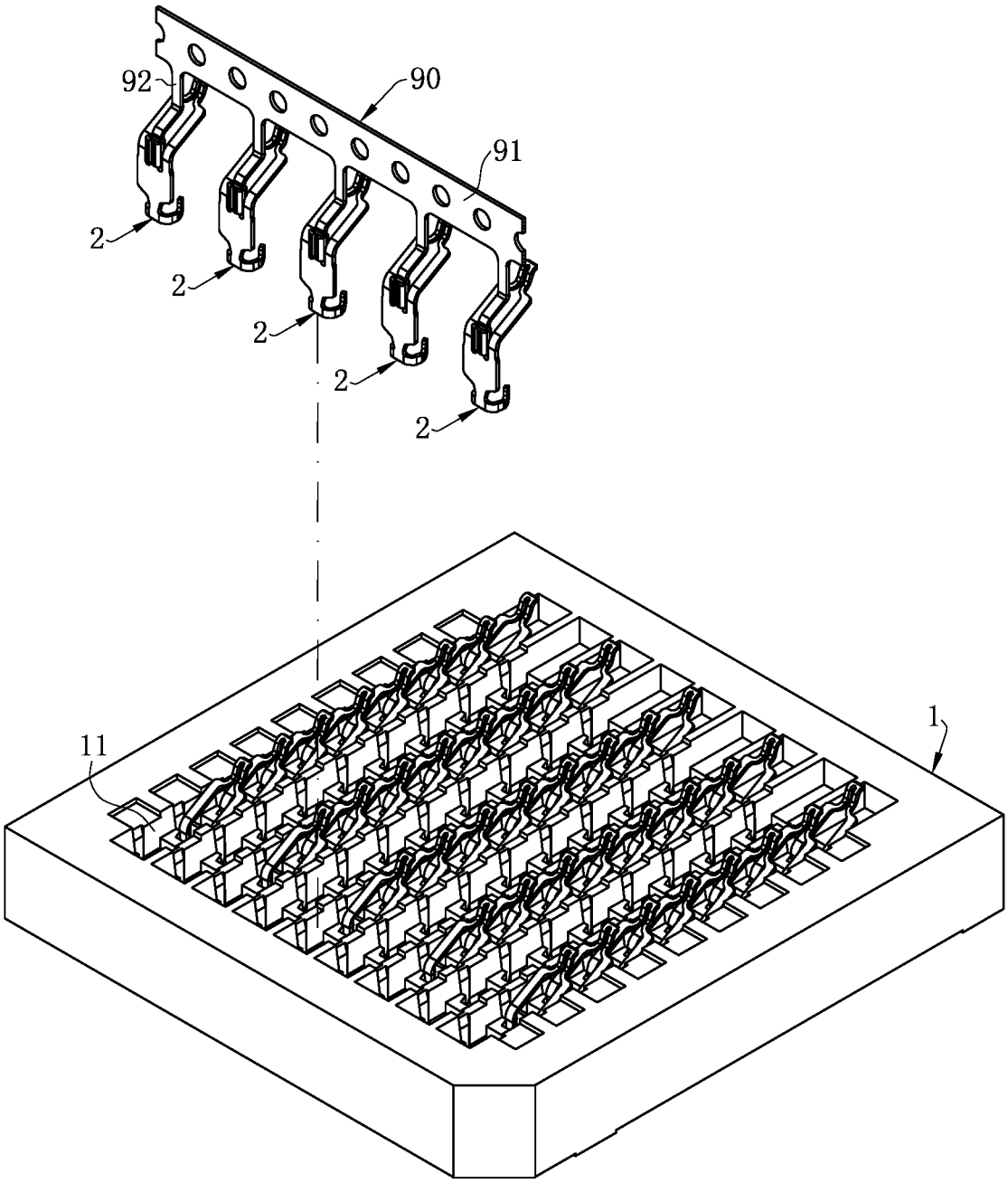
FIG. 5 is a schematic view showing that a portion of the conductive terminal of FIG. 4 has been mounted to the base after the first strip is removed.

As shown in FIG. 1 and FIG. 5, the housing 1 is made of an insulating material and has a substantially square shape, and has multiple accommodating holes 11 arranged in a matrix. Each of the accommodating holes 11 accommodates a corresponding one of the conductive terminals 2, and two sidewalls of each of the accommodating holes 11 are recessed to form two fastening slots 111 to fasten two sides of the corresponding conductive terminal 2 to limit the conductive terminal 2 from moving downward.

Figure 8:
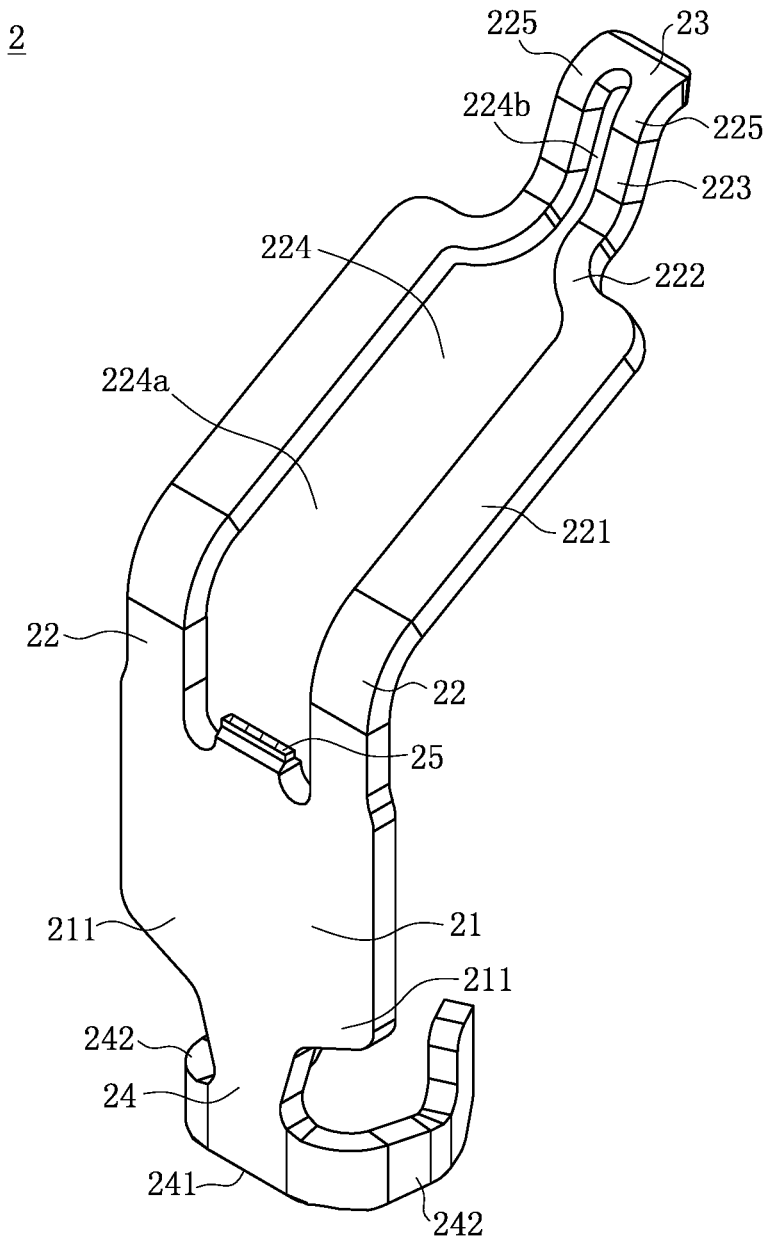
FIG. 8 is a perspective view of the conductive terminal of FIG. 7 being mounted to the accommodating hole, where the second strip is released.

As shown in FIG. 1 and FIG. 8, the conductive terminals 2 are assembled to the accommodating holes 11 downward from top thereof. Each conductive terminal 2 is made of metal. Each of the conductive terminals 2 has a body 21 in a flat plate shape. Two sides of the body 21 have two fastening portions 211, and each of the fastening portions 211 is accommodated in the corresponding fastening slot 111 and interferes with the housing 1 to limit the conductive terminal 2 from moving downward.

Figure 6:
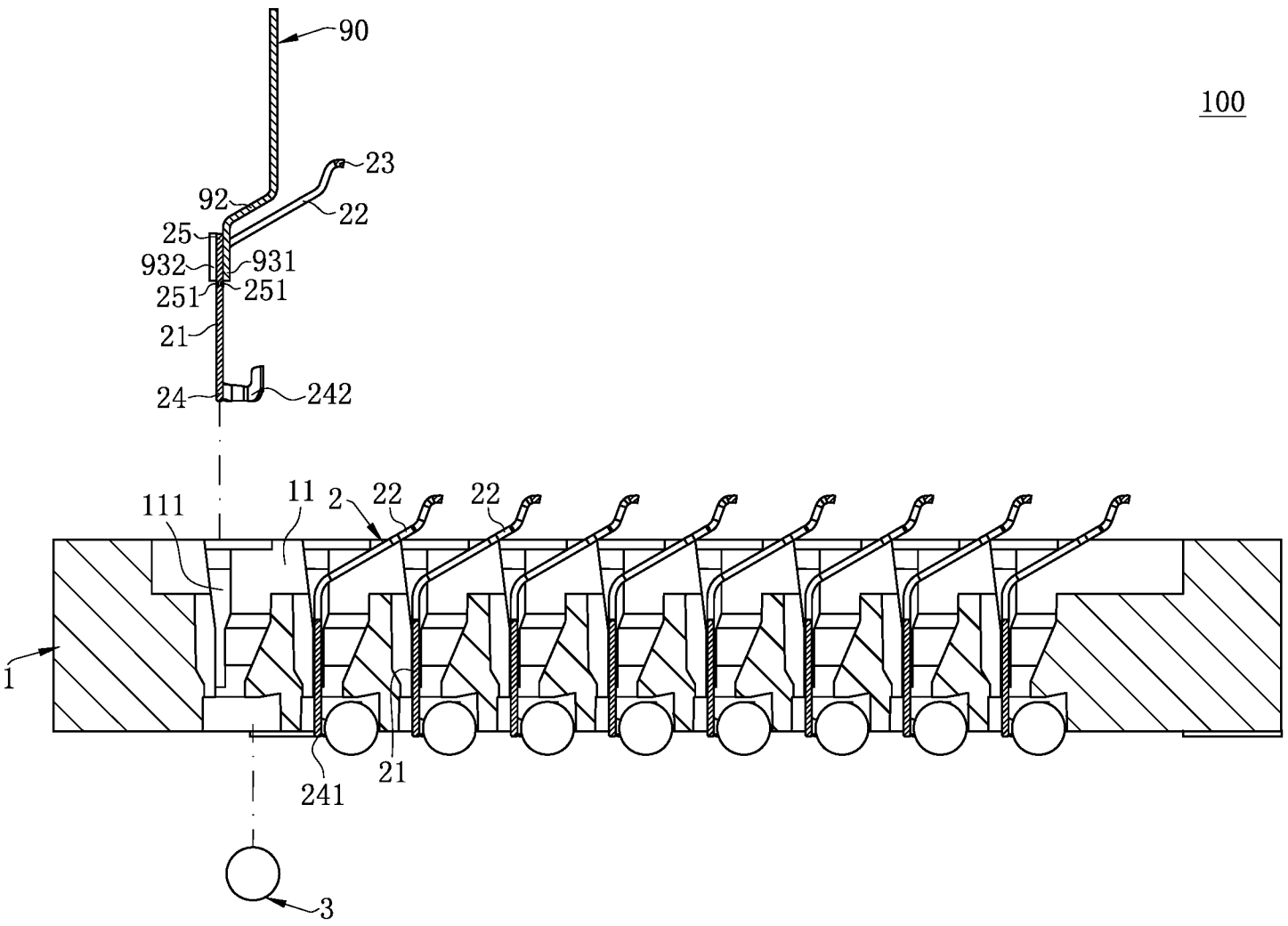
FIG. 6 is a sectional view of FIG. 5.

As shown in FIG. 1, FIG. 6 and FIG. 8, an upper end of the body 21 bends and extends upward to form two elastic arms 22. Each of the elastic arms 22 has a first section 221 connected to the body 21, a bending section 222 connected to the first section 221 and a second section 223 connected to the bending section 222. The first section 221 and the second section 223 are provided in parallel. The two first sections 221 of the two elastic arms 22 are parallel to each other, and the two second sections 223 of the two elastic arms 22 are parallel to each other. A distance between the two first sections 221 is greater than a distance between the two second sections 223. A through slot 224 is formed between the two elastic arms 22. The through slot 224 includes a first through slot **224*a* and a second through slot 224*b* in communication with each other. The first through slot 224*a* is adjacent to the body 21 and is located between the two first sections 221, and the second through slot 224*b* is located between the two second sections 223. The conductive terminals 2 are horizontally arranged in multiple rows along the extending direction of the elastic arms 22. The elastic arms 22 of one of the conductive terminals 2 in each row extend above the body 21 of another conductive terminal 2 in a previous row, and the first through slot 224***a* of each conductive terminal 2 provides a reserved space for the elastic arms 22 of other conductive terminals 2 when the chip module 60 abuts the conductive terminals 2 downward.

As shown in FIG. 1 and FIG. 8, each of the elastic arms 22 has a contact portion 225 at a tail end away from the body 21. Each of the conductive terminals 2 has a bridge portion 23 connecting the two contact portions 225 of the two elastic arms 22. That is, the bridge portion 23 connects to the tail ends of the two elastic arms 22, and the bridge portion 23 and the body 21 are located at two opposite ends of the through slot 224. The two contact portions 225 and the bridge portion 23 are used together to abut the chip module 60 upward, and the bridge portion 23 increases the contact area between the conductive terminal 2 and the chip module 60, thereby reducing the contact resistance between the conductive terminal 2 and the chip module 60.

Figure 3:
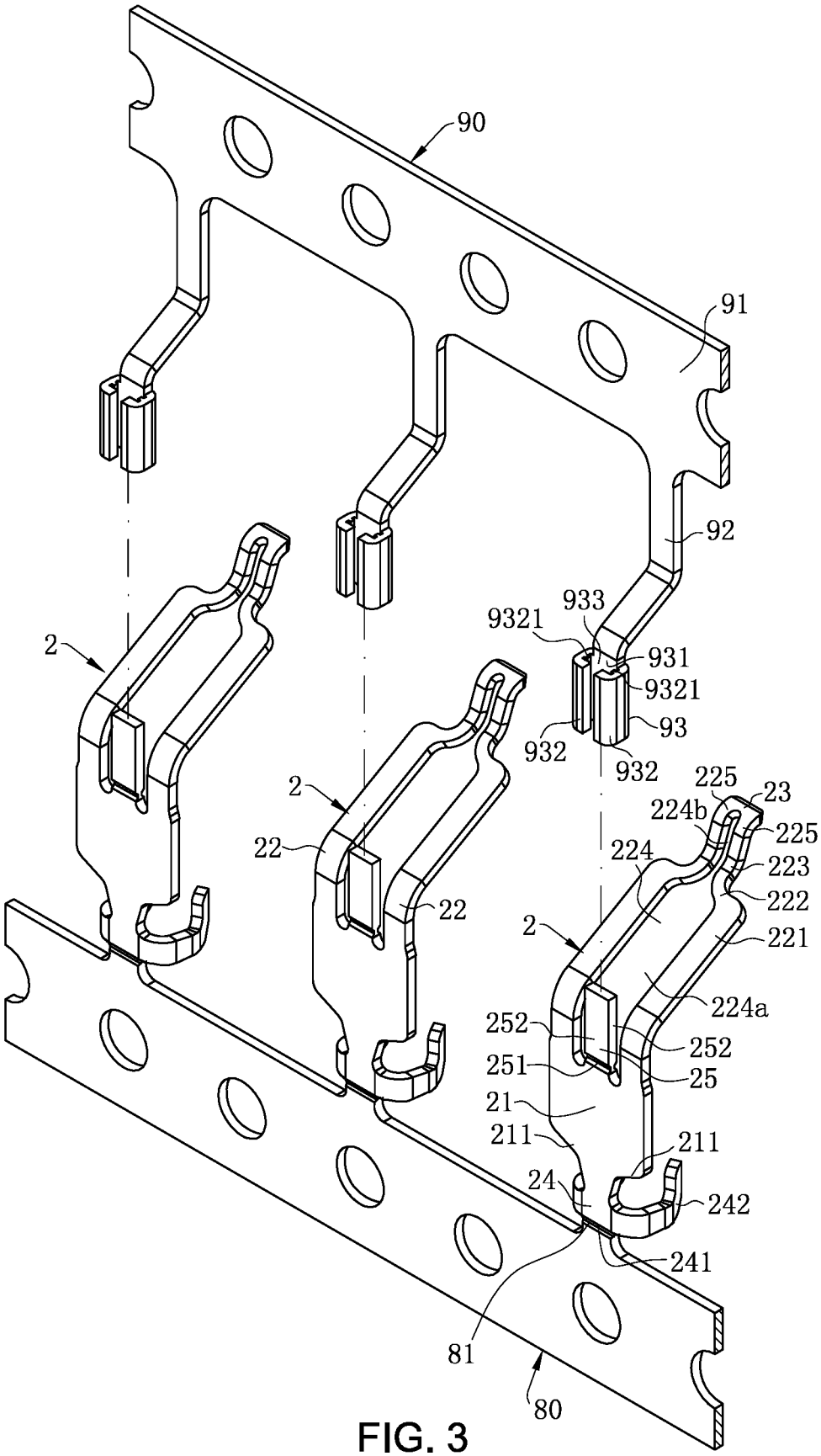
FIG. 3 is a schematic view of the conductive terminal of FIG. 2 ready to be connected to the second strip.

As shown in FIG. 3 and FIG. 6, a conducting portion 24 is connected below the body 21. A lower end of the conducting portion 24 has a strip connecting portion 241 to be connected to a first strip 80. The first strip 80 and the conductive terminals 2 are stamped and formed from the same metal plate. The conducting portion 24 has two retaining arms 242 located at two opposite sides of the strip connecting portion 241 and used to clamp the solder 3.

Figure 4:
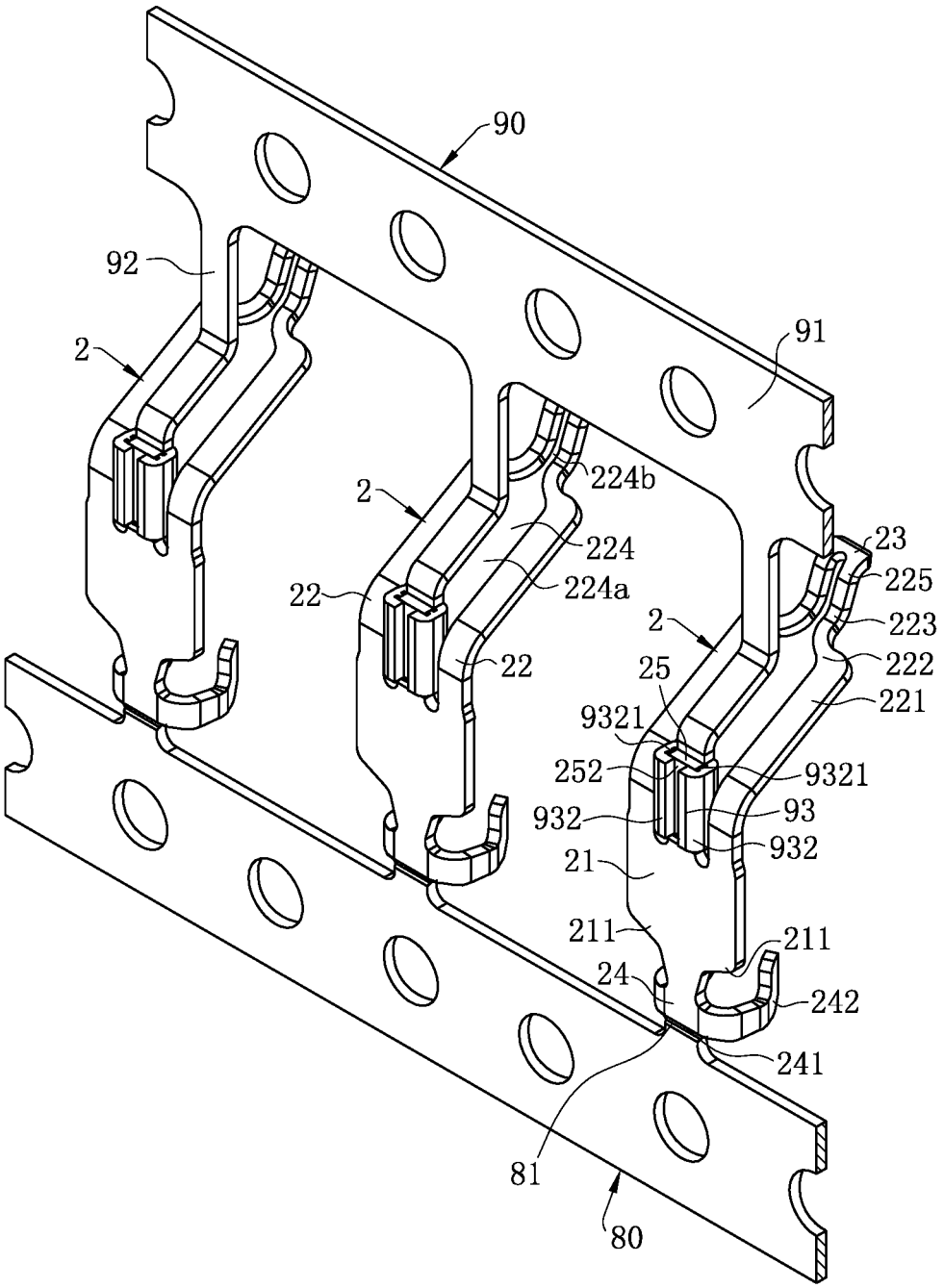
FIG. 4 is a schematic view of the second strip of FIG. 3 connected to a conductive terminal.

As shown in FIG. 3 and FIG. 4, each of the conductive terminals 2 is provided with a connecting portion 25 in a flat plate shape at an upper end of the body 21 to be connected to a second strip 90 to assist mounting the whole conductive terminal 2 to the housing 1. The connecting portion 25 and the body 21 are located on a same vertical plane. The connecting portion 25 is located between the two elastic arms 22, and a top portion of the connecting portion 25 is located outside and above the through slot 224 (also referring to FIG. 6). The connecting portion 25 has a width greater than the width of the second through slot 224*b*. An outer surface of the connecting portion 25 is formed by four side surfaces 252 and a top surface. In this embodiment, two breaking grooves 251 of equal height are stamped and formed at the two opposite side surfaces 252 of the connecting portion 25.

Figure 2:
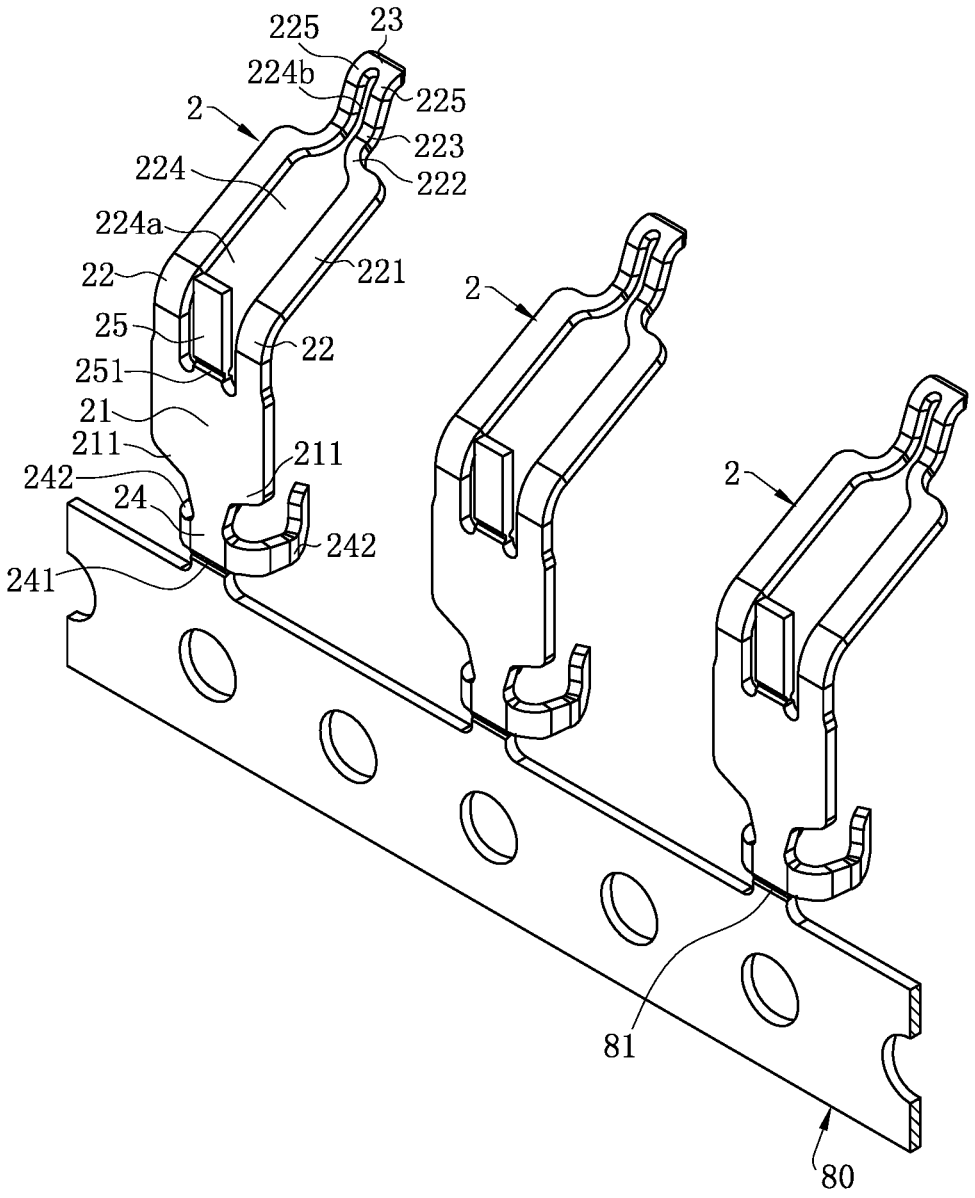
FIG. 2 is a schematic view showing the connection between the conductive terminal and the first strip according to the first embodiment of the present invention.

As shown in FIG. 2 to FIG. 7, the manufacturing method of the electrical connector 100 according to the first embodiment of the present invention includes the following steps:

As shown in FIG. 2, step 1: multiple conductive terminals 2 and a first strip 80 connected to the conductive terminals 2 are formed on the same metal plate. The structure of each conductive terminal 2 has been described above, and is thus not elaborated herein. A groove 81 is stamped and formed at each of two opposite sides of the joint between the strip connecting portion 241 and the first strip 80 to facilitate breaking.

Step 2: a second strip 90 is connected to the connecting portion 25.

As shown in FIG. 3, prior to the step 2, the second strip 90 is stamped and formed on another metal plate. The second strip 90 includes a base 91 extending horizontally and multiple connecting arms 92 protruding downward from the base 91. A bonding portion 93 is connected to a lower end of each of the connecting arms 92. Each of the connecting arms 92 connects the base portion 91 and the corresponding bonding portion 93 and extends between the base portion 91 and the corresponding bonding portion 93. The base portion 91 is deviated by the connecting arms 92 in the horizontal direction relative to the bonding portions 93 (also referring to FIG. 6). In this embodiment, the base portion 91 is located closer to the contact portion 225 relative to the bonding portion 93 in the horizontal direction. The bonding portion 93 has a flat plate portion 931 and two retaining portions 932 bending and extending from two sides of the flat plate portion 931. The flat plate portion 931 and the two retaining portions 932 define an accommodating groove 933. In this embodiment, a rib 9321 protruding into the accommodating groove 933 is formed on an inner side plate surface of each of the retaining portions 932. The ribs 9321 are formed by inwardly stamping and forming two recessed portions on the inner side plate surfaces of the retaining portions 932, so as to squeeze the metal material between the two recessed portions to protrude toward the accommodating groove 933.

As shown in FIG. 3 and FIG. 4, the specific operation of step 2 is: sleeving the bonding portions 93 of the second strip 90 over the four side surfaces 252 of the connecting portion 25 above the breaking groove 251. That is, the connecting portion 25 is sleeved in the accommodating groove 933, and the ribs 9321 of the two retaining portions 932 abut the connecting portion 25, so as to firmly fix the conductive terminal 2 and the second strip 90 together. Further, as shown in FIG. 6, each of the connecting arms 92 is provided to be higher than the elastic arms 22.

As shown in FIG. 5, step 3: the conducting portion 24 and the first strip 80 are disconnected. That is, by swinging the first strip 80 back and forth, the conductive terminal 2 and the first strip 80 are disconnected at the groove 81 of the joint of the two components, and then the first strip 80 is removed.

As shown in FIG. 5 and FIG. 6, step 4: the conductive terminal 2 is controlled by operating the second strip 90 to be assembled into the corresponding accommodating hole 11 of the housing 1 downward from top thereof.

Figure 7:
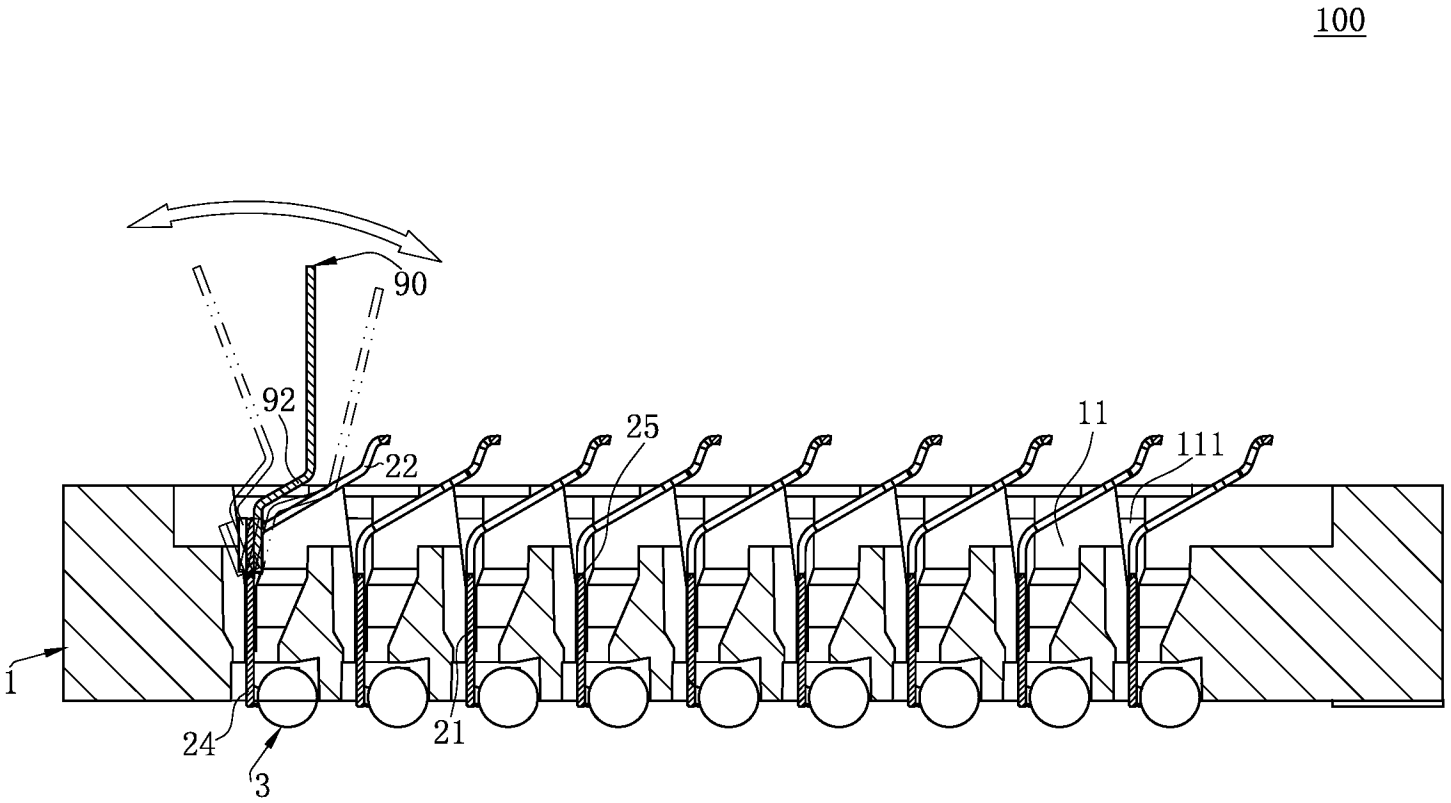
FIG. 7 is a schematic view of the conductive terminal of FIG. 6 being mounted to an accommodating hole, where the second strip is released.

As shown in FIG. 7, step 5: the control force of the second strip 90 on the conductive terminal 2 is released. In this embodiment, by swinging the second strip 90, the connecting portion 25 is broken by the breaking groove 251. The connecting portion 25 located below the breaking groove 251 remains on the body 21, and the connecting portion 25 located above the breaking groove 251 is removed together with the second strip 90. In the process of swinging the second strip 90, the second strip 90 is swung along a direction close to the elastic arms 22 and a direction away from the elastic arms 22, such that each connecting arm 92 enters and leaves the through slot 224, and the first through slot 224*a* provides a reserved space for the swing of the second strip 90.

After the step 5, the solder 3 is fixed between the two retaining arms 242 of the conducting portion 24.

Figure 9:
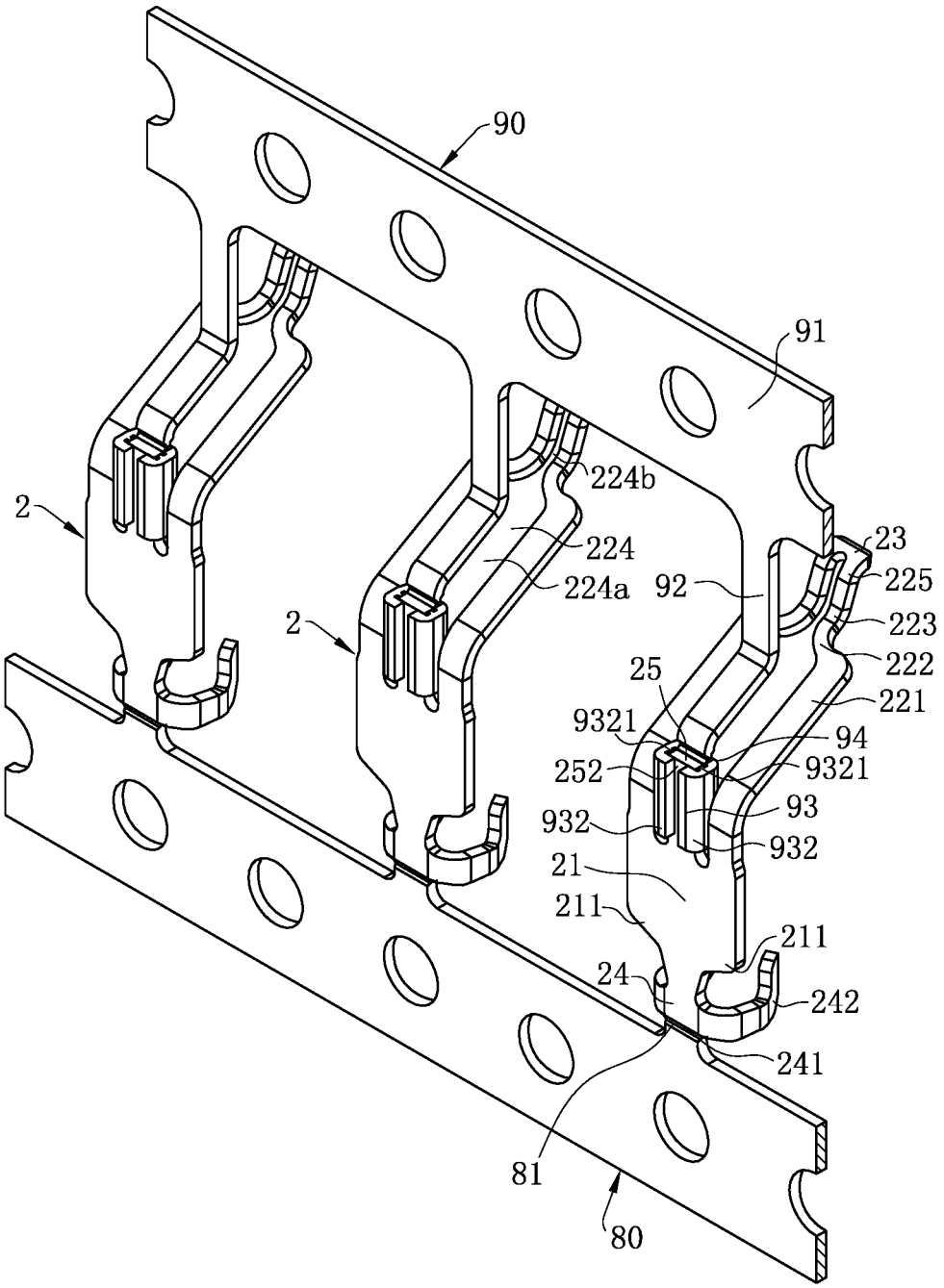
FIG. 9 is a schematic view showing the connection between a conductive terminal and a second strip of an electrical connector according to a second embodiment of the present invention.
Figure 10:
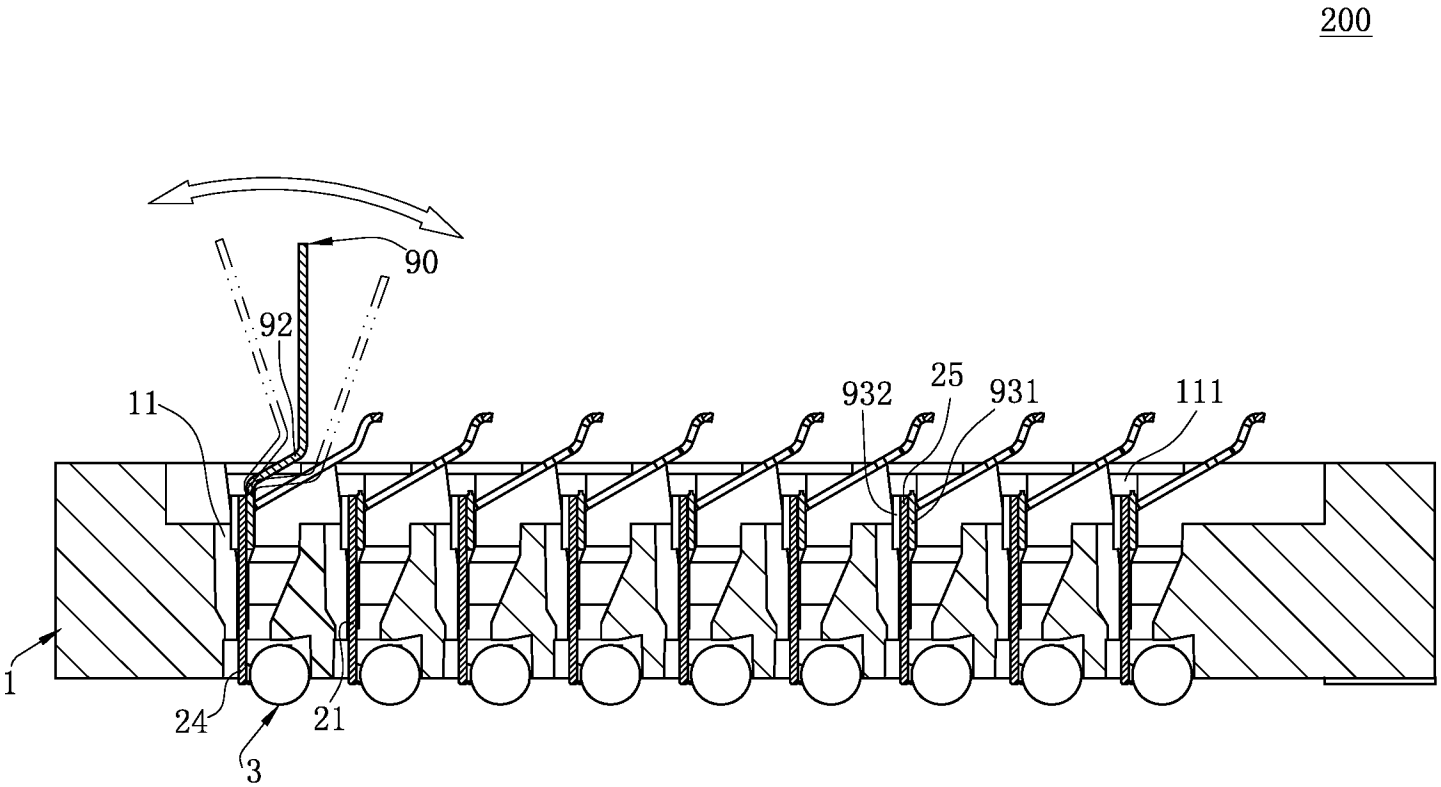
FIG. 10 is a schematic view of the conductive terminal of FIG. 9 being mounted to an accommodating hole, where the second strip is released.
Figure 11:
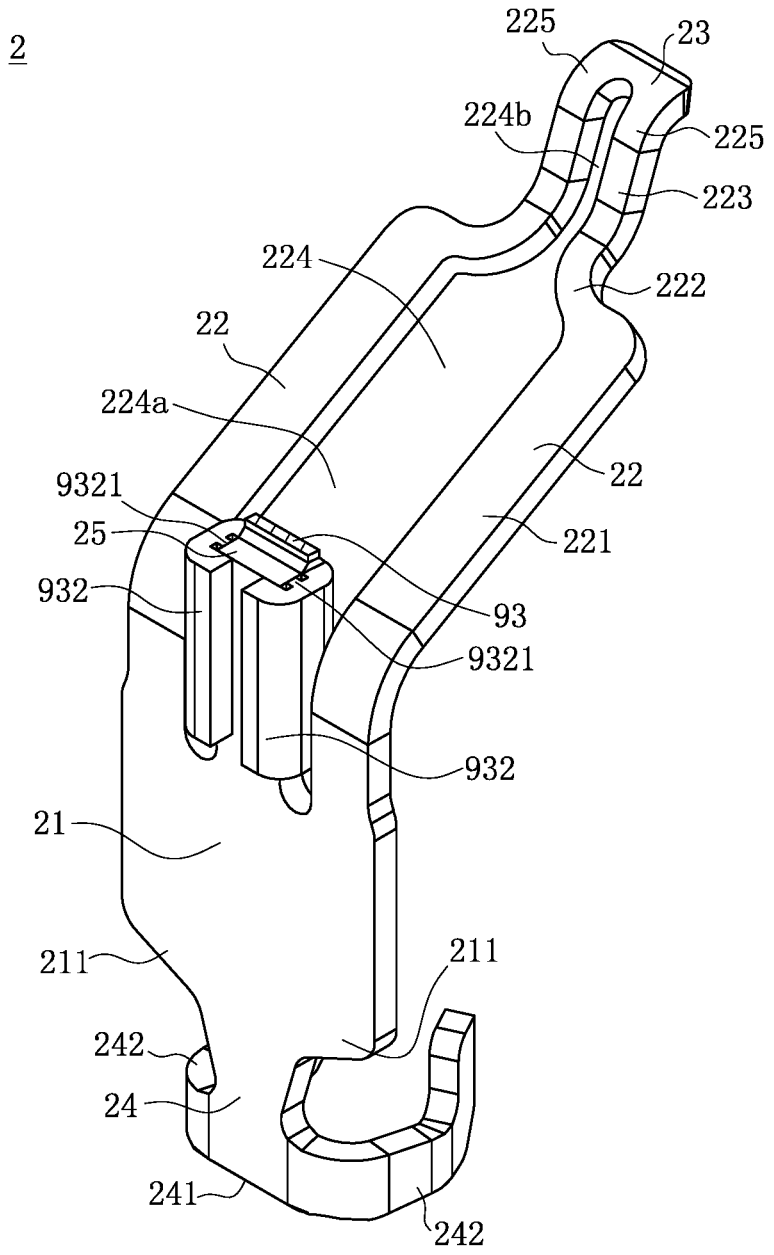
FIG. 11 is a perspective view of the conductive terminal of FIG. 10 being mounted to the accommodating hole, where the second strip is released.

FIG. 9 to FIG. 11 show an electrical connector 200 and a method for manufacturing the same according to a second embodiment of the present invention. In this embodiment, prior to the step 2, two pre-breaking grooves 94 of equal height are stamped and formed on two opposite sides of the connecting arm 92 of the second strip 90, and the pre-breaking grooves 94 are located above the bonding portion 93. In the step 5, the second strip 90 is swung such that the connecting arm 92 is broken by the pre-breaking groove 94, the bonding portion 93 located below the pre-breaking groove 94 remains on the connecting portion 25 of the conductive terminal 2, and the second strip 90 other than the bonding portion 93 is removed. That is, in this embodiment, the connecting portion 25 remains intact without breaking, and the connecting arm 92 is broken in the step 5, leaving the bonding portion 93 on the connecting portion 25. Other structures and manufacturing steps of the electrical connector 200 are identical to those in the first embodiment, and are indicated by the same reference numerals, which can be referred to in the first embodiment. In other embodiments, the breaking of the conductive terminals 2 from the first strip 80 and the second strip 90 may adopt other manners, such as a laser cut or the like, instead of providing the grooves 81 and the pre-breaking grooves 94.

Figure 12:
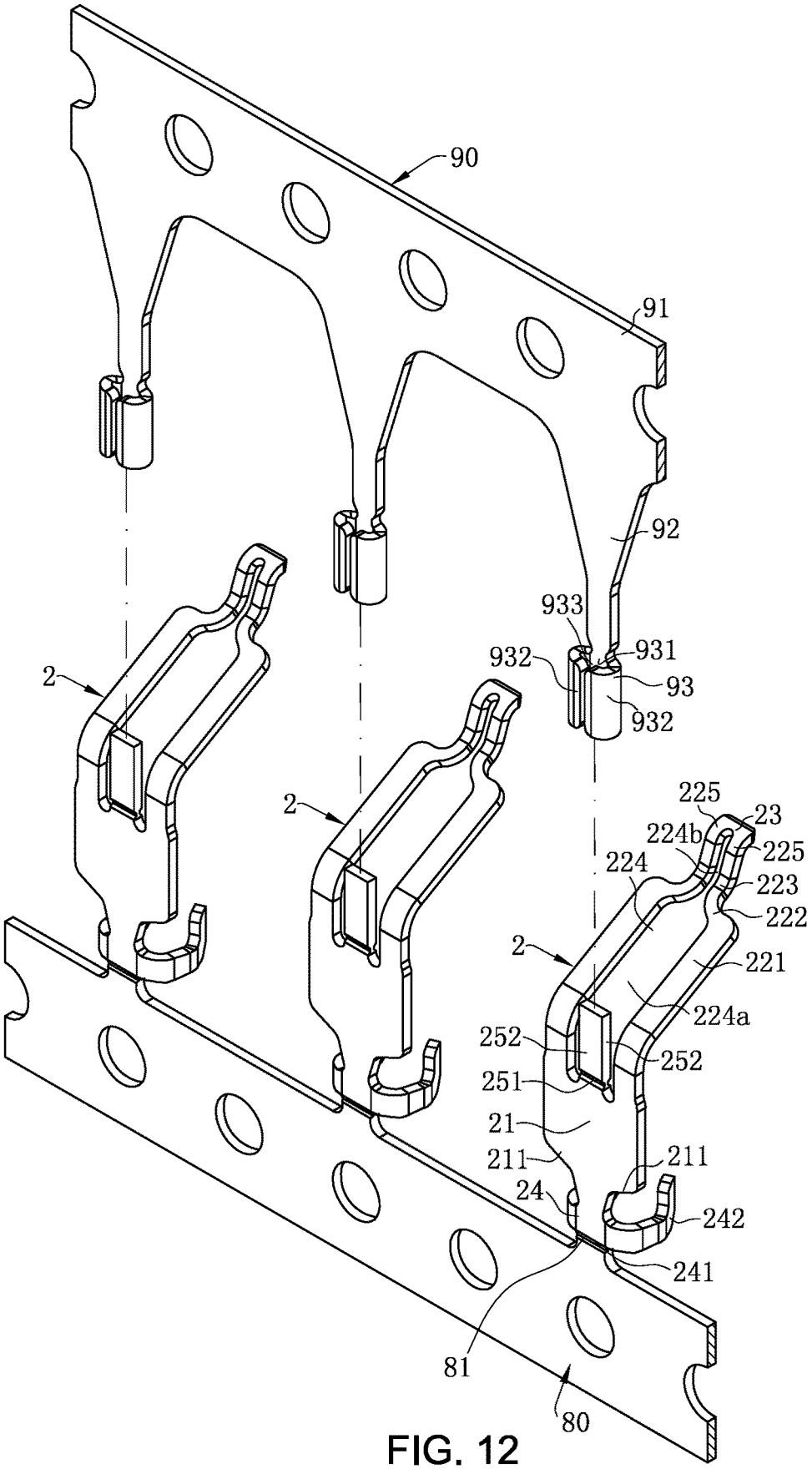
FIG. 12 is a schematic view showing a conductive terminal ready to be connected to a second strip of an electrical connector according to a third embodiment of the present invention.
Figure 13:
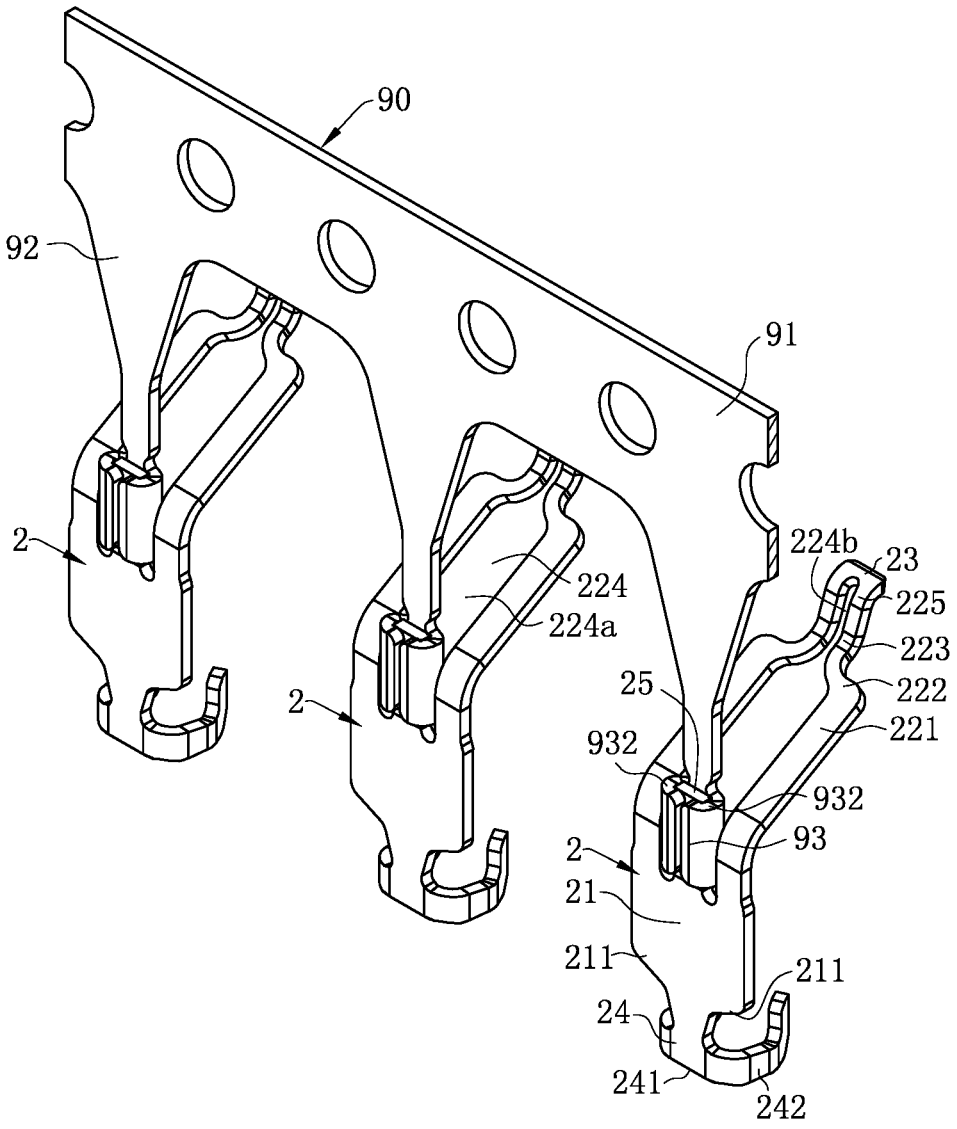
FIG. 13 is a schematic view of the second strip of FIG. 12 being connected to the conductive terminal.

FIG. 12 and FIG. 13 show a method for manufacturing an electrical connector according to a third embodiment of the present invention. In this embodiment, the inner side plate surface of each retaining portion 932 is not provided with a rib. Compared to the first and second embodiments, the retaining force of the bonding portions 93 and the connecting portion 25 is appropriately reduced. In the step 5, the second strip 90 is pulled upward, the bonding portions 93 move upward and are released from the connecting portion 25, and the second strip 90 is completely removed from the connecting portion 25. Other structures and manufacturing steps of the electrical connector 200 are identical to those in the first embodiment, and are indicated by the same reference numerals, which can be referred to in the first embodiment.

In addition to the embodiments of the present invention as described above, the present invention may be applied in an embodiment where only one conductive terminal 2 is provided. Correspondingly, the second strip 90 only has one connecting arm 92 and one bonding portion 93.

To sum up, the electrical connector and the method for manufacturing the same according to certain embodiments of the present invention have the following beneficial effects:

1. The strip connecting portion 241 to be connected to the first strip 80 is provided on the conducting portion 24, the conducting portion 24 is located below the body 21, the connecting portion 25 to be connected to the second strip 90 is located above the body 21 and located between the two elastic arms 22, and the strip connecting portion 241 and the connecting portion 25 do not laterally protrude from the conductive terminal 2. Thus, the conductive terminal 2 occupies less space, which facilitates the electrical connector 100 accommodating more conductive terminals 2 per unit area, thereby facilitating miniaturization of the electrical connector 100. Since the strip connecting portion 241 and the connecting portion 25 do not laterally protrude from the conductive terminal 2, a certain distance is reserved between the conductive terminal 2 and other surrounding conductive terminals 2. Thus, it is not easy for the conductive terminal 2 to crosstalk with other surrounding conductive terminals 2, which is advantageous for transmitting high frequency signals.

2. The arrangement of the two elastic arms 22 increases the conductive paths of the conductive terminal 2, and the first through slot 224*a* provided between the two elastic arms 22 provides a reserved space for the second strip 90 when the connecting portion 25 or the connecting arm 92 is broken in the step 5. The conductive terminals 2 are horizontally arranged in multiple rows along the extending direction of the elastic arms 22. The elastic arm 22 of one of the conductive terminals 2 in each row extends above the body 21 of another conductive terminal 2 in a previous row, and the first through slot 224*a* of each conductive terminal 2 provides a reserved space for the elastic arms 22 of other conductive terminals 2 when the chip module 60 abuts the conductive terminals 2 downward.

3. The inner side plate surface of each retaining portion 932 is provided with the rib 9321 abutting the connecting portion 25, which can increase the retaining force of the second strip 90 on the connecting portion 25, facilitating maintenance of the control of the second strip 90 on the conductive terminal 2 in the step 4, and also facilitating breaking of the breaking groove 251 by the second strip 90 in the step 5 of the first embodiment.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for manufacturing an electrical connector, comprising:

step 1: forming at least one conductive terminal and a first strip connected to the at least one conductive terminal, wherein the conductive terminal has a conducting portion provided at a lower end thereof and connected to the first strip, two elastic arms provided at an upper end thereof, and a connecting portion located between the two elastic arms;

step 2: connecting a second strip to the connecting portion;

step 3: disconnecting the conducting portion and the first strip;

step 4: operating the second strip to control the conductive terminal to be mounted to a housing; and step 5: releasing a control force of the second strip onto the conductive terminal.

2. The method according to claim 1, wherein:

prior to the step 2, at least one bonding portion is formed on the second strip;

in the step 2, the bonding portion is fixed to the corresponding connecting portion; and in the step 5, the connecting portion is broken below the bonding portion to remove the second strip.

3. The method according to claim 2, wherein:

in the step 1, a breaking groove is formed on the connecting portion;

in the step 2, the bonding portion is connected to the connecting portion above the breaking groove; and in the step 5, the connecting portion is broken by the breaking groove.

4. The method according to claim 2, wherein:

a base portion and at least one connecting arm are formed on the second strip being provided, the connecting arm connects the base portion and the corresponding bonding portion and extends between the base portion and the corresponding bonding portion, and the base portion is deviated by the connecting arm in the horizontal direction relative to the bonding portion;

in the step 2, the connecting arm is provided to be higher than the elastic arms; and in the step 5, the second strip is swung along a direction close to the elastic arms and a direction away from the elastic arms.

5. The method according to claim 4, wherein:

in the step 1, a through slot is formed on the conductive terminal, and the through slot is located between the two elastic arms; and in the step 5, in a process of swinging the second strip, the connecting arm enters and leaves the through slot.

6. The method according to claim 1, wherein:

prior to the step 2, at least one bonding portion is formed on the second strip;

in the step 2, the bonding portion is fixed to the corresponding connecting portion; and in the step 5, the second strip is broken at a portion other than the bonding portion to remove the second strip other than the bonding portion.

7. The method according to claim 6, wherein:

prior to the step 2, at least one pre-breaking groove is formed at a portion other than the bonding portion on the second strip; and in the step 5, the second strip is broken by the pre-breaking groove.

8. The method according to claim 6, wherein:

a base portion and at least one connecting arm are formed on the second strip being provided, the connecting arm connects the base portion and the corresponding bonding portion and extends between the base portion and the corresponding bonding portion, and the base portion is deviated by the connecting arm in the horizontal direction relative to the bonding portion;

in the step 2, the connecting arm is provided to be higher than the elastic arms; and in the step 5, the second strip is swung along a direction close to the elastic arms and a direction away from the elastic arms.

9. The method according to claim 8, wherein:

in the step 1, a through slot is formed on the conductive terminal, and the through slot is located between the two elastic arms; and in the step 5, in a process of swinging the second strip, the connecting arm enters and leaves the through slot.

10. The method according to claim 1, wherein:

prior to the step 2, at least one bonding portion is formed on the second strip, wherein the bonding portion has a flat plate portion and two retaining portions formed by bending and extending from two sides of the flat plate portion, and the flat plate portion and the two retaining portions defines an accommodating groove; and in the step 2, the connecting portion is sleeved in the accommodating groove.

11. The method according to claim 10, wherein:

prior to the step 2, at least one rib is formed on an inner side plate surface of each of the retaining portions to protrude into the accommodating groove; and in the step 2, the ribs of the two retaining portions abut the connecting portion.

12. The method according to claim 1, wherein in the step 5, the second strip is completely removed from the connecting portion.

13. The method according to claim 1, wherein in the step 1, a through slot is formed on the conductive terminal, the through slot is located between the two elastic arms, and the conductive terminal has a bridge portion connecting the two elastic arms.

14. The method according to claim 1, wherein in the step 1, a metal plate is provided, and the at least one conductive terminal and the first strip are formed on the metal plate, each of the at least one conductive terminal has a body being flat plate shaped and the two elastic arms formed by extending upward from the body, the connecting portion is flat plate shaped and is connected to an upper end of the body, and the connecting portion and the body are located on a same vertical plane.

15. The method according to claim 14, wherein in the step 1, a through slot is formed on the conductive terminal, the through slot is formed between the two elastic arms, and a top portion of the connecting portion is located outside and above the through slot.

* * * * *